US005205216A

United States Patent [19]

Okamura et al.

[11] Patent Number: 5,205,216

[45] Date of Patent: Apr. 27, 1993

[54] INKING UNIT

[75] Inventors: Yuichi Okamura; Hideo Ohta, both of Tokyo, Japan

[73] Assignee: Kabushiki Kaisha Tokyo Kikai Seisakusho, Tokyo, Japan

[21] Appl. No.: 713,733

[22] Filed: Jun. 11, 1991

[30] Foreign Application Priority Data

Oct. 3, 1990 [JP] Japan ..... 2-266106

[51] Int. Cl.[5] ..... B41F 31/02

[52] U.S. Cl. ..... 101/367; 101/350

[58] Field of Search ..... 101/367, 350, 351

[56] References Cited

U.S. PATENT DOCUMENTS

| | | | |
|---|---|---|---|
| 3,205,816 | 9/1965 | Heimlicher | 101/366 |
| 4,026,210 | 5/1977 | Merzagora | 101/367 |
| 4,149,463 | 4/1979 | Kobayashi et al. | 101/365 |
| 4,497,250 | 2/1985 | Dressler | 101/350 |
| 4,690,055 | 9/1987 | Fadner et al. | 101/350 |
| 4,864,925 | 9/1989 | Van Kanegan et al. | 101/350 |

FOREIGN PATENT DOCUMENTS

| | | | |
|---|---|---|---|
| 0137227 | 5/1950 | Australia | 101/366 |
| 0309681 | 4/1989 | European Pat. Off. . | |
| 63-18244 | 2/1988 | Japan . | |
| 63-572236 | 3/1988 | Japan . | |
| 63-16522 | 5/1988 | Japan . | |
| 66-1940 | 1/1989 | Japan . | |
| 64-001940 | 1/1989 | Japan . | |
| 1-113244 | 3/1989 | Japan . | |
| 1177493 | 1/1970 | United Kingdom . | |
| 1310833 | 3/1973 | United Kingdom . | |
| 2121725 | 1/1984 | United Kingdom . | |

OTHER PUBLICATIONS

"Coater with Upper and Lower Pan" H. W. Terwilliger, IBM Technical Disclosure Bulletin, vol. 25, No. 10, Mar. 1983 pp. 5372–5373.

*Primary Examiner*—Edgar S. Burr
*Assistant Examiner*—anthony H. Nguyen
*Attorney, Agent, or Firm*—Trexler, Bushnell, Giangiorgi & Blackstone, Ltd.

[57] ABSTRACT

There is provided an inking unit comprising an ink circulating assembly and means for moving a platform on which said ink circulating assembly is provided. The ink circulating assembly includes the ink fountain provided in an ink reservoir, ink outlet means for introducing the ink into the ink fountain, the ink reservoir having an open top and designed to surround the ink fountain from beneath the ink fountain, a screw conveyor arranged along the longitudinal direction within the ink reservoir for conveying the ink mixing the excess dampening water therewith and diffusing the excess dampening water therinto, and a pipe connecting between the ink reservoir and the ink outlet means. The means for moving the platform includes a lifter for vertically moving the platform, and casters for horizontally moving the platform. Thus, the means for moving the platform can be used both as adjustment of a position of the ink fountain in relation to the roller and as removal of the ink circulating assembly to repair and/or to change one to another.

1 Claim, 5 Drawing Sheets

INKING UNIT

BACKGROUND OF THE INVENTION

1. Field of the Invention

The present invention relates to an inking unit for use in a printing machine and in particular, to an inking unit suitable for a keyless rotary offset press, which enables better transfer of ink from an ink fountain to the peripheral surface of a roller.

2. Description of the Related Art

Recently, a keyless inking unit has increasingly been used in order to simplify printing operation and allow an operator to operate a printing machine with less experimentation. There have been proposed various ink units for use in a rotary offset press wherein damping water invades to an ink supply system (see, for example, Japanese utility model publication No. 16522/88, Japanese laid-open utility model publication No. 18244/88, Japanese laid-open patent publication No. 57236/88, Japanese laid-open utility model publication No. 1940/89 and Japanese laid-open patent publication 113244/89).

Of the prior art, Japanese laid-open patent publication No. 57236/88 and Japanese laid-open patent publication No. 113244/89 disclose systems for supplying a mixture of ink and water. Ink is supplied from a tray or a ink fountain to a roller. The bottom of the ink fountain is arcuate so as to correspond to the curvature of the outer peripheral surface of the roller.

Japanese laid-open utility model publication No. 1940/89 discloses an ink feed mechanism all mounted on a movable carriage.

If relatively large water droplets in ink are not finely divided, the ink may not evenly or properly transferred to the peripheral surface of a roller. This results in a decrease in the quality of end product.

It is therefore desirable to finely divide such water droplets so that the water droplets may evenly be distributed in the ink.

Also, it is desired that an ink feed mechanism may rapidly be assembled or disassembled for inspection, maintenance replacement of ink or repair when the mechanism is suddenly out of order.

SUMMARY OF THE INVENTION

This invention is based upon the hereinafter-mentioned prior art, namely, an ink supply system of a keyless offset rotary printing press wherein excess dampening water from a water supply system invades the ink supply system, the ink supply system comprising an ink fountain adapted to feed ink onto the peripheral surface of a roller, the distance between the bottom of the ink fountain and the peripheral surface of the roller being decreased gradually from the upstream end to the downstream end of the ink fountain in the direction of rotation of the roller.

The roller may be a fountain roller or an ink metering roller. The minimum distance is, for example, no greater than 5 mm.

According to aspect of the invention, there is provided an inking unit comprising an ink circulating assembly and means for moving a platform on which said ink circulating assembly is provided.

The ink circulating assembly includes the ink fountain provided in an ink reservoir, ink outlet means for introducing the ink into the ink fountain, the ink reservoir having an open top and designed to surround the ink fountain from beneath the ink fountain, a screw conveyor arranged along the longitudinal direction within the ink reservoir for conveying the ink mixing the excess dampening water therewith and diffusing the excess dampening water thereinto, a pipe connecting between the ink reservoir and the ink outlet means.

The means for moving the platform includes a lifter for vertically moving the platform, and casters for horizontally moving the platform.

Thus, the means for moving the platform can be used both as adjustment of a position of the ink fountain in relation to the roller and as removal of the ink circulating assembly to repair and/or to change one to another.

BRIEF DESCRIPTION OF THE DRAWINGS

For a better understanding of the present invention, reference may be made to the following description of preferred embodiments when taken in conjunction with the accompanying drawings, in which.

DESCRIPTION OF THE PREFERRED EMBODIMENT

The present invention will now be described by way of example with reference to the drawings.

Figure 1:
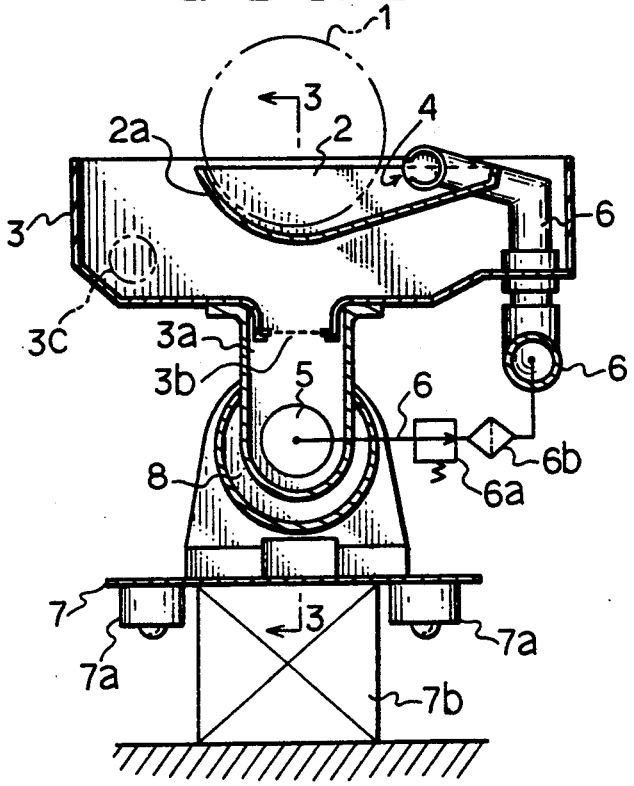
FIG. 1 is a transverse sectional left side view taken along the line 1—1 in FIGS. 2 and 3 showing an inking unit according to one embodiment of the present invention.

Referring to FIG. 1, a roller 1 corresponds to a fountain roller 1*a* (FIG. 8) or an ink metering roller 1*b* (FIG. 9) provided at the upstream end of a set of inking rollers. The former or fountain roller 1*a* is rotated in a clockwise direction or in the same direction as the roller 1, whereas the latter 1*b* is rotated in a counterclockwise direction. Ink is supplied from an ink fountain 2 to the roller 1, 1*a* or 1*b*. The ink fountain 2 has a sufficient length to receive the lower portion of the roller and extends between opposite sides of an ink reservoir 3 with the distance between a bottom 2*a* of the ink fountain 2 and the peripheral surface of the roller being gradually decreased from the upstream end to the downstream end of the ink fountain in the direction of rotation of the roller.

Ink outlet means such as an ink outlet 4 extends along the upper side of the ink fountain 2 and is adapted to introduce ink to the ink fountain 2.

The ink reservoir 3 has an open top to surround the ink fountain 2 from its bottom and is adapted to receive overflow ink and excess dampening water from the ink fountain 2 and ink and excess dampening water removed by first and second ductor blades as will later be described.

Figure 3:
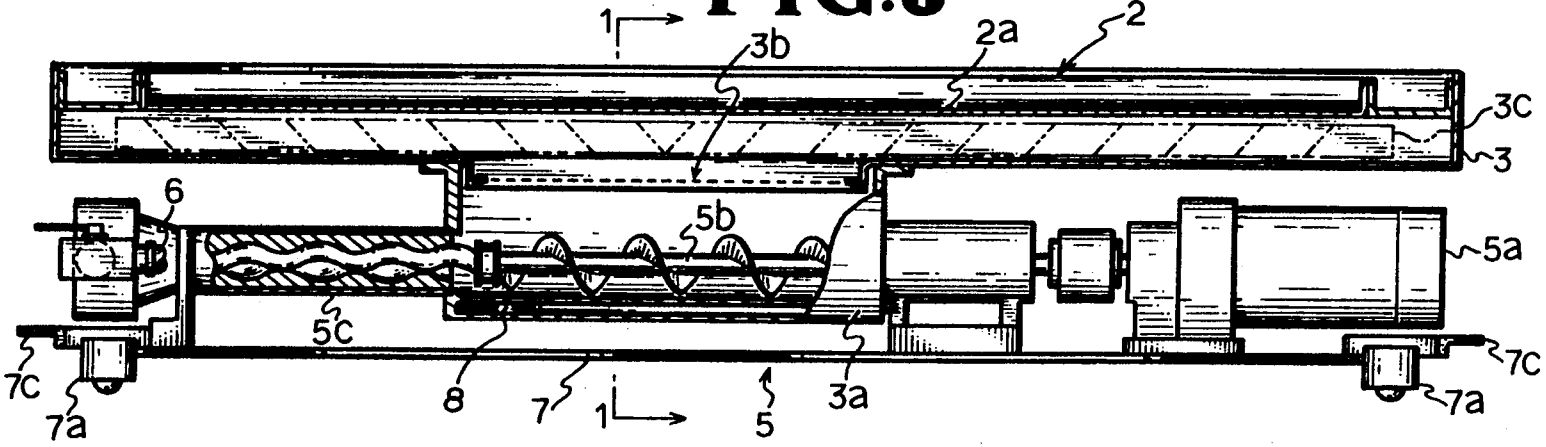
FIG. 3 is a transverse sectional front view taken along the line 3—3 in FIG. 1.

The ink reservoir 3 has a central opening at its bottom. A filter 3b is fit to the central opening of the ink reservoir 3. An ink transfer chamber 3a is defined below the ink reservoir 3 and communicated therewith through the filer 3b. As shown in FIG. 3, ink transfer means 5 is mounted within the ink transfer chamber 3a and driven by a drive source such as an electric motor 5a. The ink transfer means 5 typically comprises a screw conveyor 5b mounted directly on the output shaft of the electric motor 5a, and a pump 5c. By this arrangement, the screw conveyor 5b is rotated to feed ink from the ink transfer chamber 3a toward the pump 5c. The ink and the excess dampening water is then pumped out by the pump 5c and fed under pressure to an ink feed pipe 6.

The feed pipe 6 extends between the ink transfer means 5 and the ink outlet 4. Pressure applying means such as a pressure valve 6a and/or filter means such as a strainer or a filter 6b are mounted to the feed pipe 6 between the ink transfer means 5 and the ink outlet 4.

The ink transfer chamber 3a of the ink reservoir 3 is mounted on a platform 7. The ink transfer chamber 3a, the pressure applying means 6a, the filter means 6b and the drive source 5a are assembled together as a unit. A plurality of casters 7a are mounted to the platform 7 to allow horizontal movement of the above-mentioned ink circulating assembly. A lifter 7b is also arranged below the frame to allow vertical movement of the above-mentioned ink circulating assembly.

Figure 2:
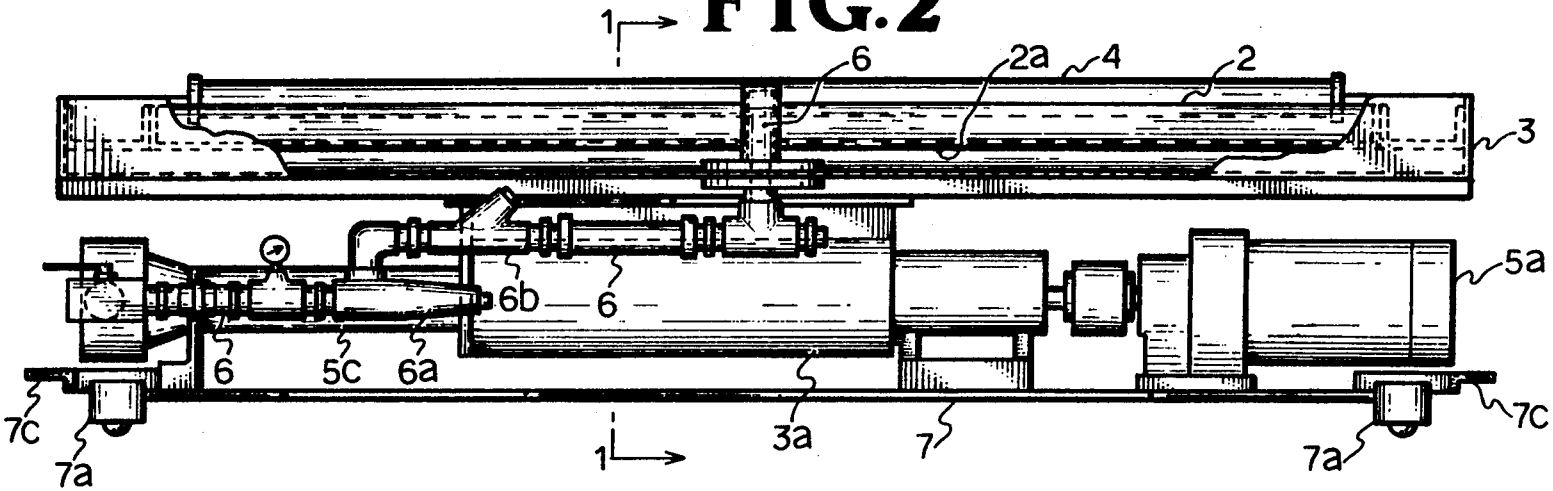
FIG. 2 is a front view, partly broken away, of the inking unit shown in FIG. 1.

Referring to FIGS. 2 and 3, fixed elements 7c extend from left and right ends of the platform 7 and are engageable with corresponding elements (not shown) of the lifter 7b so as not only to adjust longitudinal and lateral positions of the roller 1, 1a or 1b, but also to transmit vertical movement of the lifter 7b to the platform 7. A stopper (not shown) is adapted to limit upper movement of the lifter 7b. The distance between the peripheral surface of the roller 1 and the bottom 2a of the ink fountain 2 has previously been adjusted to an optimal value. The lifter 7b is locked by a suitable means when the unit is moved up to a predetermined position. Alternatively, the lifter 7b may be arranged on the platform 7 to position the roller 1, 1a or 1b by a suitable means.

In the embodiment shown in FIG. 3, the transfer chamber 3a of the ink reservoir 3 has inner and outer walls. A space 8 is defined between the inner and outer walls of the transfer chamber 3a. A heat transfer means (not shown) is detachably mounted through a plug or other means (not shown) to circulate fluid in the space 8 so as to adjust the temperature of ink.

As shown in FIGS. 1 to 3, a screw conveyor 3c extends along the ink fountain 2 and has right and left hand flights in a confronting relation. The screw conveyor 3c is driven to allow ink and excess dampening water to flow from opposite ends of the ink reservoir 3 toward the center of the ink reservoir 3.

Figure 8:
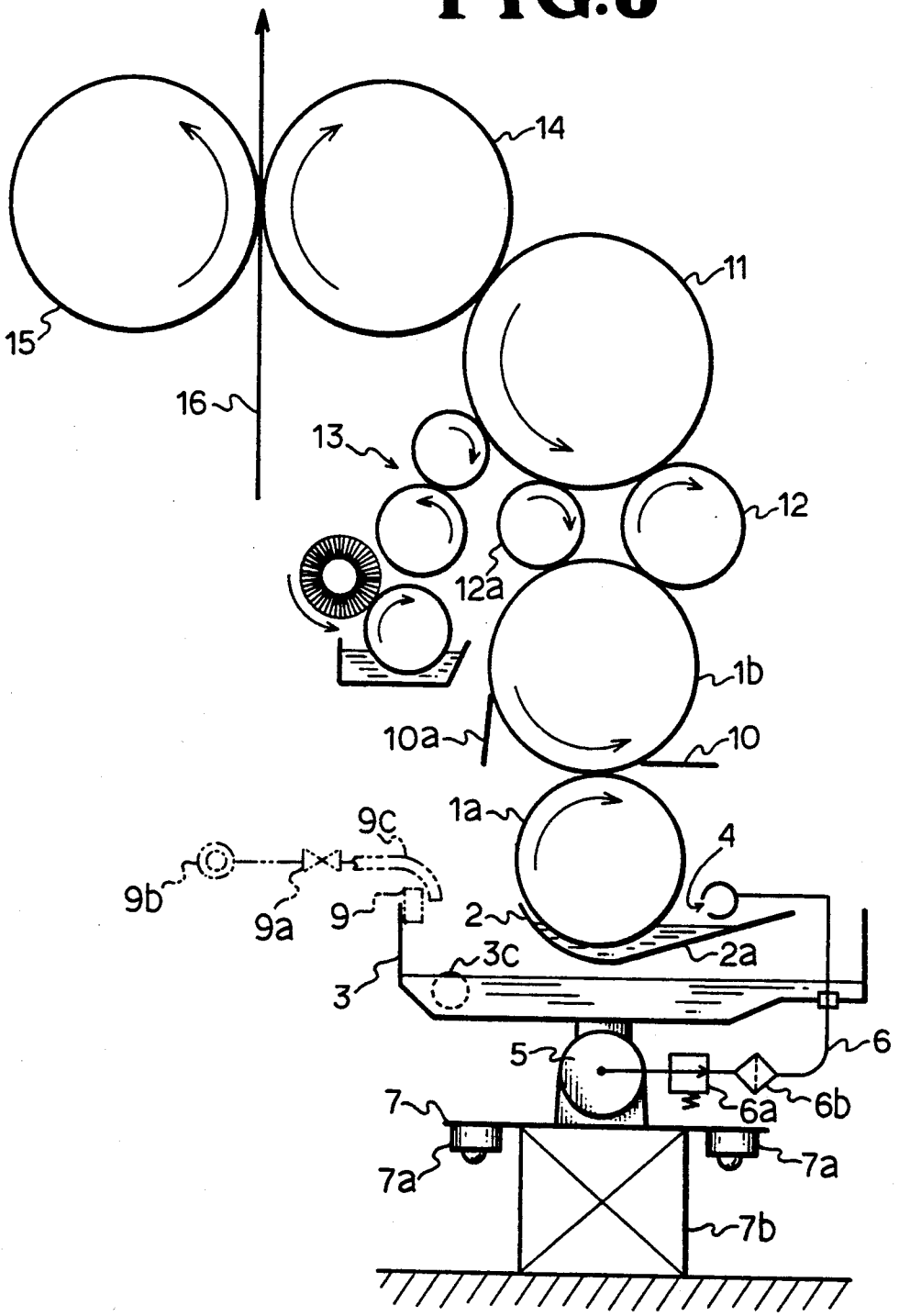
FIG. 8 is a schematic view of a keyless rotary offset press wherein a fountain roller is arranged in the inking unit of the present invention.
Figure 9:
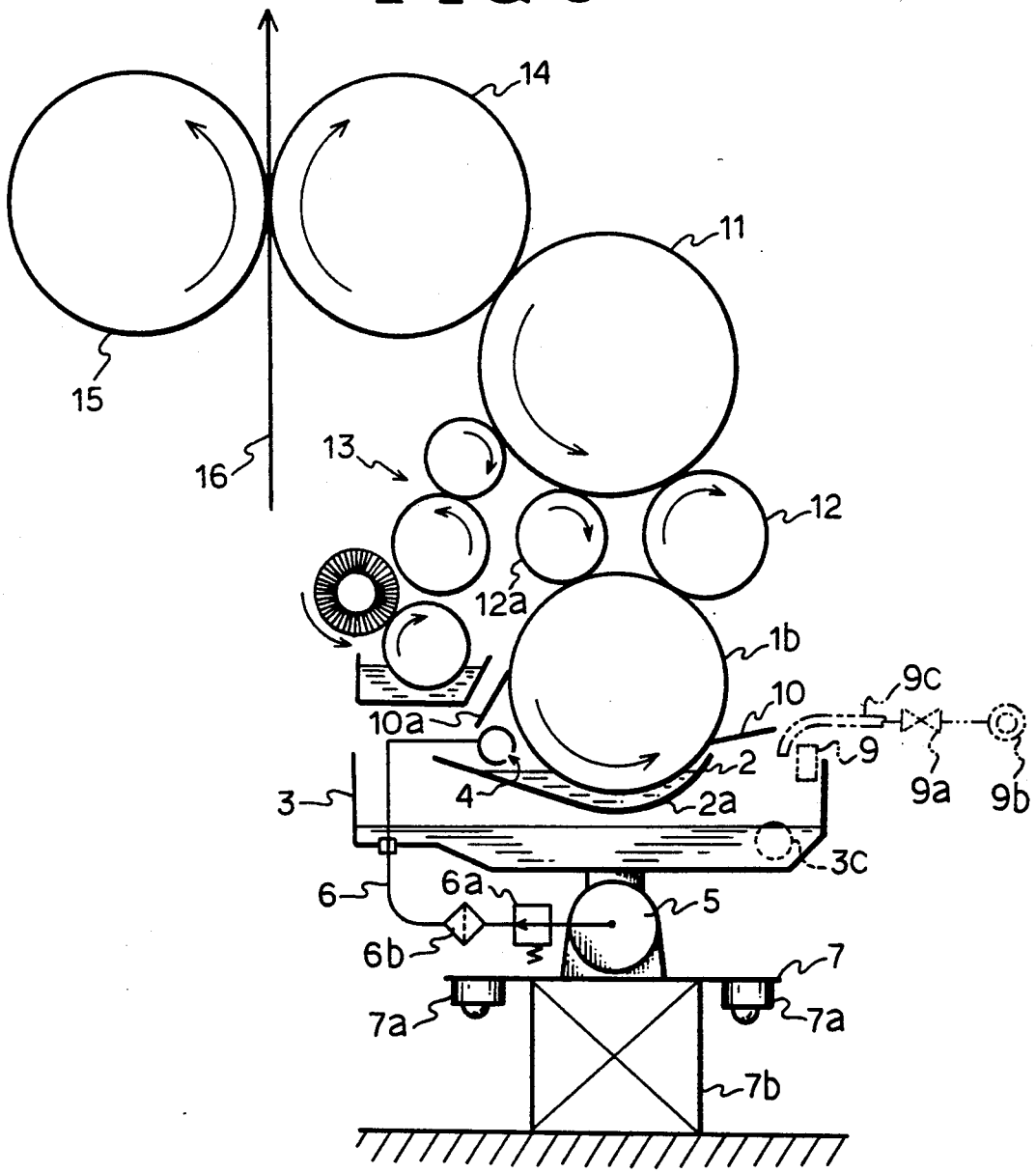
FIG. 9 is a schematic view of a keyless rotary offset press wherein an ink metering roller is arranged in the inking unit of the present invention.

Ink is consumed as the printing machine is operated. To this end, ink replenishing means is provided to replenish the inking unit. As shown in FIGS. 8 and 9, such a means includes an ink level sensor 9 attached to the ink reservoir 3, a valve 9a openable in response to a signal sent from the sensor 9, an ink replenishing source 9b adapted to feed additional ink to the inking unit through the valve 9a, and an ink replenishing pipe 9c.

FIGS. 8 and 9 show keyless rotary offset presses, each with the inking unit according to the present invention. In the rotary offset press shown in FIG. 8, the fountain roller 1a is located at the upstream end of a set of inking rollers as earlier discussed. Ink is fed from the ink fountain 2 through the fountain roller 1a to the ink metering roller 1b. In the rotary offset press shown in FIG. 9, the ink metering roller 1b per se is located at the upstream end of a set of inking rollers. The rest of components is identical to one another. Specifically, first and second ductor blades 10 and 10a are in abutment with the peripheral surface of the ink metering roller 1b. A pair of form rollers 12 and 12a are disposed between the ink metering roller 1b and a plate cylinder 11 so as to feed ink to a printing plate (not shown). A damping unit 13 is adapted to supply damping water to the printing plate. A blanket cylinder 14 is in abutment with the plate cylinder 11. An impression or second blanket cylinder 15 is in abutment with the first blanket cylinder 14. A sheet 16 passes through the first and second blanket cylinders 14 and 15.

Figure 4:
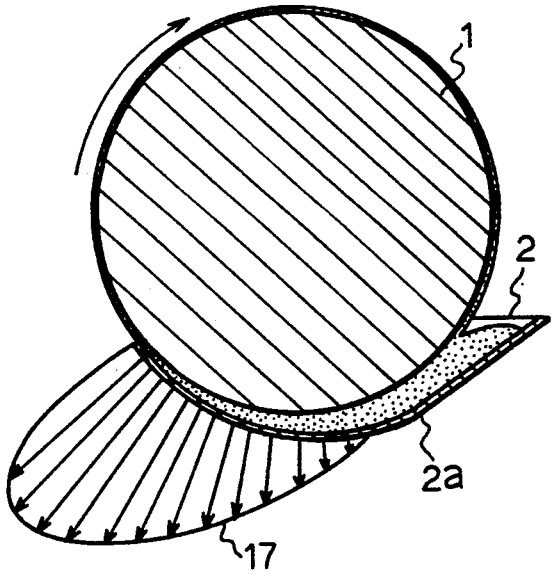
FIG. 4 is a view showing the manner in which ink is better transferred to the peripheral surface of a roller according to the principle of the present invention.

In operation, as the roller 1 is rotated in a clockwise direction, a laminer flow of ink is moved between the peripheral surface of the roller 1 and the bottom of the ink fountain 2. The distance between the roller 1 and the bottom of the ink fountain 2 is narrower gradually from the upstream end to the downstream end of the ink fountain 2 in the direction of rotation of the roller 1. This results in a gradual increase in the pressure applied to the ink as indicated by reference numeral 17 in FIG. 4. The ink is press strongly against the peripheral surface of the roller 1. This provides better transfer of the ink onto the peripheral surface of the roller 1.

Figure 5:
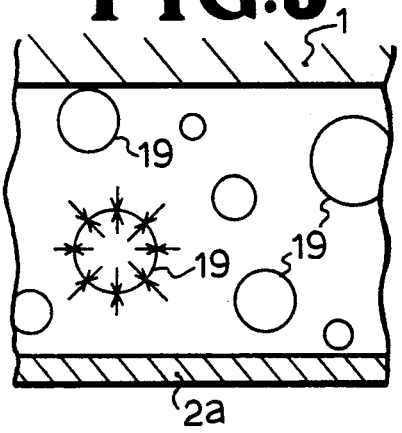
FIGS. 5 to 7 are enlarged views showing the manner in which with the inking unit of the present invention used in a keyless rotary offset press, water droplets are gradually divided and evenly distributed in ink while pressure is applied to the ink and a laminer flow of ink is displaced, FIG. 5 showing water droplets when the ink is not flowing, and FIGS. 6 and 7 showing the manner in which water droplets are extended and divided while the ink is flowing.
Figure 6:
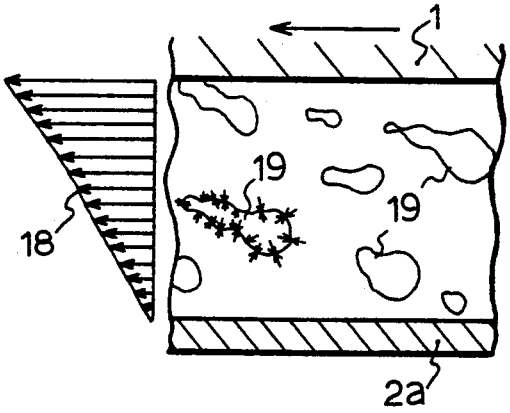
Figure 7:
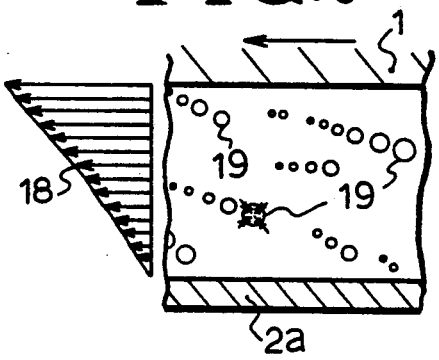

The principle of better transfer of the ink onto the peripheral surface of the roller according to the present invention, when used in a keyless rotary offset press, is as follows. Water droplets (see FIGS. 5 to 7), as an extra amount of damping water introduced into the ink through a line as will later be described, are spherical in FIG. 5. As shown in FIG. 6, they are extended due to pressure applied to the peripheral surface of the roller and difference in vertical displacement of a laminer flow of ink, that is, the closer to the peripheral surface of the roller, the greater the displacement of the ink. As a result, external pressure and internal pressure become no longer equal. Eventually, the water droplets are finely divided and distributed in the ink as shown in FIG. 7. Under the circumstances, the ink can evenly be attached and better transferred to the peripheral surface of the roller since the water droplets have been finely divided.

In a keyless rotary offset press with the inking unit of the present invention, water and ink are well mixed to prevent any problems due to the presence of water.

Tests, carried out by the applicant, have shown that damping water can be divided finer when the minimum distance between the peripheral surface of the roller and the bottom of the ink fountain 2 is no greater than 5 mm.

After the ink has been transferred to the peripheral surface of the roller 1a or 1b, it is fed through a pair of form rollers 12 and 12a to lines in the printing plate (not shown) which extends around the plate cylinder 11. On the other hand, damping water is fed from the damping unit 12 to the other part of the printing plate. An extra amount of damping water then flows over the peripheral surface of the ink metering roller 1*b* through the form rollers 12 and 12*a*.

The first ductor blade 10 is adapted to remove an extra amount of ink. In addition thereto, the second ductor blade 10*a* is provided to remove an extra amount of damping water from the peripheral surface of the ink metering roller 1*b*. The damping water thus removed drops in the reservoir 3 and is then mixed with ink.

A mixture of water and ink is fully agitated in the ink reservoir 3 by the screw conveyor 5*b* and the pump 5*c* and then, fed to the pipe 6. The mixture flows in a laminer manner through the pipe and is introduced to the ink fountain 2 through the ink outlet 4. Some of water droplets in the ink have been divided until then. If additional pressure is applied to a laminer flow of ink through the pipe 6, external pressure applied to the water droplets and internal pressure become unequal to allow easy division of the water droplets. The pressure valve 6*a* is provided to promote division of the water droplets. Also, the strainer or the line filter 6*b* is provided in the pipe 6 to eliminate small foreign substance.

An extra amount of ink or water in the mixture flows from the ink fountain 2 into the ink reservoir 3.

The screw conveyor 5*b* and the pump 5*c* are driven by the drive source 5*a* to agitate and feed the ink or the mixture from the ink reservoir 3 to the pipe 6. The ink or the mixture is then fed to the ink fountain 2 through the ink outlet 4. The ink is circulated in this order. Part of the ink tends to remain in opposite ends of the ink reservoir 3. To this end, the screw conveyor 3*c* extends along the ink reservoir 3 and has right and left hand flights in a confronting relation. The screw conveyor 3*c* is driven by a suitable drive means (not shown) at all times or when necessary during operation of the printing machine so as to allow the ink to flow from the ends of the ink reservoir 3 to an area in which the ink can be circulated.

In order to clean up the ink circulating assembly, replace the used ink with the new ink, maintain and inspect the unit, replace parts after use, or repair when the assembly is suddenly out of order, the ink circulating assembly is moved to another position. More specifically, the lifter 7 is first unlocked to lower the unit until the casters 7*a* come into contact with the ground. Thereafter, the engaging elements (not shown) of the lifter are disengaged from the fixed elements 7*c*. The assembly is then horizontally moved by the casters 7*a*. Replacement of ink circulating assemblies can be effected in a reverse order.

The present invention is not limited to the foregoing embodiments. It is therefore understood that various changes may be made without departing from the scope of the invention as defined by the appended claims.

What is claimed is:

1. In an ink supply system of a keyless offset rotary printing press wherein excess dampening water from a water supply system invades the ink supply system, the ink supply system in which a roller and an ink fountain adapted to supply ink onto a peripheral surface of said roller are relatively arranged such that the distance between an internal bottom surface of said ink fountain and the peripheral surface of said roller is decreased gradually to a downstream end from an upstream end of said ink fountain in the direction of rotation of said roller, an inking unit comprising an ink circulating assembly including said ink fountain provided in said ink reservoir, ink outlet means for introducing the ink into said ink fountain, an ink reservoir having an open top and surrounding said ink fountain from beneath the ink fountain, a screw conveyor arranged along the longitudinal direction within said ink reservoir for conveying the ink and mixing said excess dampening water therewith and diffusing said excess dampening water thereinto, and a pipe connecting said ink reservoir and said ink outlet means;

a platform on which said ink circulating assembly is mounted, and means for moving said platform, including a lifter for vertically moving said platform, and casters for horizontally moving said platform, in order for use both as adjustment of a position of said ink fountain in relation to said roller and as removal of said ink circulating assembly to repair and/or to change one to another.

* * * * *